US007211161B2

(12) United States Patent
Pillet et al.

(10) Patent No.: US 7,211,161 B2
(45) Date of Patent: May 1, 2007

(54) AL-MG ALLOY PRODUCTS SUITABLE FOR WELDED CONSTRUCTION

(75) Inventors: Georges Pillet, Saint Cassin (FR); Jerome Guillemenet, Issoire (FR); Ronan Dif, Saint Etienne de Saint Geoirs (FR); Christine Henon, Claix (FR); Herve Ribes, Issoire (FR)

(73) Assignee: Alcan Rhenalu, Paris (FR)

( * ) Notice: Subject to any disclaimer, the term of this patent is extended or adjusted under 35 U.S.C. 154(b) by 11 days.

(21) Appl. No.: 10/392,310

(22) Filed: Mar. 20, 2003

(65) Prior Publication Data

US 2004/0003872 A1 Jan. 8, 2004

(30) Foreign Application Priority Data

Mar. 22, 2002 (FR) ..... 02 03593

(51) Int. Cl.
*C22C 21/06* (2006.01)

(52) U.S. Cl. ..... 148/440; 420/543; 420/542; 420/541

(58) Field of Classification Search ..... 420/541, 420/542, 543, 544, 535; 148/440
See application file for complete search history.

(56) References Cited

U.S. PATENT DOCUMENTS

| | | | |
|---|---|---|---|
| 5,908,518 | A | 6/1999 | Hoffmann et al. |
| 6,056,836 | A | 5/2000 | Hoffman et al. |

FOREIGN PATENT DOCUMENTS

| | | |
|---|---|---|
| EP | 0769564 A1 | 4/1997 |
| EP | 0823489 | 2/1998 |
| EP | 0823489 A1 | 2/1998 |
| EP | 0892858 B1 | 2/2000 |
| JP | 62207850 | 9/1987 |
| JP | 01104865 | 4/1989 |
| JP | 02285045 | 11/1990 |
| WO | WO 99/17903 | 4/1999 |

OTHER PUBLICATIONS

"Metals Handbook: Desk Edition", 2nd ed., ASM International, 1998, pp. 445,447,448.*
"Aluminum Standards and Data 2003", Aluminum Association Inc, p. 1-6.*
Y.L. Wu et al.; "Microstructure and Properties of a New Super-High-Strength Al-Zn-Mg-Cu Alloy C912", Materials & Design, vol. 18, Nos. 4/6 1997, pp. 211-215.
Cottignies, L. et al, AA 5186: a new aluminum alloy for welded construction, Pechiney Centre de Recherches de Voreppe et al, Feb. 26, 1999.

* cited by examiner

*Primary Examiner*—Roy King
*Assistant Examiner*—Janelle Morillo
(74) *Attorney, Agent, or Firm*—Womble Carlyle

(57) ABSTRACT

The invention relates to an Al—Zn—Mg—Cu alloy worked product, characterised in that contains (percentage by weight)

| | | | |
|---|---|---|---|
| Mg 4.85–5.35 | Mn 0.20–0.50 | Zn 0.20–0.45 | |
| Si < 0.20 | Fe < 0.30 | Cu < 0.25 | Cr < 0.15 |
| Ti < 0.15 | Zr < 0.15 | | |

the remainder being aluminium with its inevitable impurities.

This product preferentially has an elongation at fracture $A_{(LT)}$ of at least 24% and an $Rm_{(LT)} \times A_{(LT)}$ parameter of at least 8500. It shows a good stress and intergranular corrosion resistance.

It may be used for welded constructions, particularly tankers, motor car bodywork, and industrial vehicles.

33 Claims, No Drawings

AL-MG ALLOY PRODUCTS SUITABLE FOR WELDED CONSTRUCTION

CLAIM FOR PRIORITY

The present invention claims priority under 35 U.S.C. § 119 from French Patent Application No. 02-03593 filed Mar. 22, 2002, the content of which is incorporated herein by reference in its entirety.

BACKGROUND OF THE INVENTION

1. Field of the Invention

The present invention relates generally to high mechanical resistance Al—Mg type alloys, and more particularly, to alloys intended for welded constructions, such as those used for motor car body panels and constructions, industrial vehicles and fixed, mobile tanks and the like.

2. Description of Related Art

To increase the mechanical resistance of welded constructions while decreasing their weight, it is of interest to have, with respect to the 5083, 5086, 5182, 5186 or 5383 alloys currently used, enhanced mechanical characteristics without losing any of the properties generally desirable for end use applications. These properties include weldability, corrosion resistance or formability, particularly in low cold-worked tempers such as the O temper and the H111 temper. (The designation of these alloys follows the rules of The Aluminum Association and that of the metallurgical tempers is defined in the European standard EN 515.)

To design a structure, the parameters governing a user's choice are essentially the static mechanical characteristics, that is, ultimate tensile strength $R_m$, tensile yield strength $R_{p02}$ and the elongation at fracture A. Other parameters which are involved, according to the specific requirements of the target application, include the mechanical characteristics of the welded seam, the corrosion resistance of the sheet and the welded seam, the fatigue strength of the sheet and the welded seam, the crack propagation rate, the fracture toughness, the bendability, the weldability, the propensity for residual stress formation under specific sheet manufacturing and usage conditions, as well as the ability to produce sheets of uniform quality with the lowest possible production cost.

The state of the art offers several processes to enhance the mechanical characteristics to Al—Mg type alloys. For example, EP 769 564 A1 (Pechiney Rhenalu) discloses an alloy of the following composition (percentage by weight): Mg 4.2–4.8 Mn<0.5 Zn<0.4 Fe<0.45 Si<0.30 where Mn+Zn<0.7 and Fe>0.5 Mn. The alloy may also contain other elements, making it possible to manufacture sheets having an $R_m$>275 MPa, A>17.5% and an $R_m$×A product>6500 in a low cold worked state. In a better-controlled composition, it is possible to increase the $R_m$×A product to a value greater than 7000 and even greater than 7500. Alloys of this type are used under the Aluminum Association reference 5186 in welded road tanker construction. For this application, the $R_m$×A product is used as a parameter to estimate the behaviour of the structures under deep plastic deformation, for example in the event of an accident. Those skilled in the art know how to increase, in any of the known Al—Mg type alloys, one of the two parameters $R_m$ and A to the detriment of the other. EP 769 564 A1 discloses that sheets with an improved compromise between said two parameters may be obtained if the sheet has a very particular microstructure. The 5186 alloy sheets are characterised not only by a high $R_m$×A product, but also by a high value of A, which favours the bending of the sheets and facilitates their use in mechanical construction.

Another process is proposed by the patent application JP 62 207850 (Sky) which discloses alloys of the following composition (percentage by weight):

| | | | | |
|---|---|---|---|---|
| Mg 2–6 | Mn 0.05–1.0 | Cr 0.03–0.3 | Zr 0.03–0.3 | V 0.03–0.3 |

and which may also contain Cu 0.05–2.0 and/or Zn 0.1–2.0. These alloys are produced by continuous casting and the intermetallic particle size thereof is less than or equal to 5 μm. Such alloys would be useful for manufacture of sheets for motor car bodyworks, since such alloys could be subjected to very particular thermo-mechanical treatment procedures, in order to form sheets of a thickness of 1 mm, which in turn, do not show Lüders lines.

Another process is proposed by EP 0 892 858 B1 (Hoogovens Aluminium Walzprodukte GmbH) which discloses alloys of the composition

| | | | |
|---|---|---|---|
| Mg 5–6 | Mn 0.6–1.2 | Zn 0.4–1.5 | Zr 0.05–0.25 |

and which may also contain other elements. Such an alloy could potentially be used to manufacture very hard alloys, particularly with a zinc content of the order of 0.8%. These products show an elongation at fracture not exceeding a value of the order of 10% in the H321 temper and 20% in the O temper.

EP 823 489 B1 (Pechiney Rhenalu) discloses products of the following composition

| | | | |
|---|---|---|---|
| 3.0 < Mg < 6.5 | 0.2 < Mn < 1.0 | Fe < 0.8 | 0.05 < Si < 0.6 |
| Zn < 1.3 | | | |

and which may also contain other elements. These products are characterised by a very particular microstructure, and are not devised to be used for tanker construction, but for welded constructions used in contact with seawater or in a maritime environment.

SUMMARY OF THE INVENTION

An object of the present invention is to enhance the mechanical characteristics of Al—Mg alloy products, particularly with a view to their use to produce welded constructions, such as road or rail hazardous substance transport tankers, while retaining the other characteristics, including physical and chemical properties of the material at a level at least comparable to that of existing materials.

In accordance with these and other objects, the present invention is directed to an Al—Mg alloy worked (or wrought) product, characterised in that contains (percentage by weight)

| | | |
|---|---|---|
| Mg 4.85–5.35 | Mn 0.20–0.50 | Zn 0.20–0.45 |
| Si < 0.20 | Fe < 0.30 | Cu < 0.25 |
| Cr < 0.15 | Ti < 0.15 | Zr < 0.15 |

the remainder being aluminium with its inevitable impurities.

In yet further accordance with the present invention, there is provided another embodiment directed to a road or rail tanker produced at least partially with sheets of the following composition (percentage by weight):

| | | |
|---|---|---|
| Mg 4.90–5.35 | Mn 0.20–0.50 | Zn 0.25–0.45 |
| Si 0.05–0.20 | Fe 0.10–0.30 | Cu < 0.25 |
| Cr < 0.15 | Ti < 0.15 | Zr < 0.10 |

the remainder being aluminium with its inevitable impurities, The sheets preferably have an $R_{m(LT)} \times A_{(LT)}$ product of at least 8500, and preferentially of at least 9000.

Additional objects, features and advantages of the invention will be set forth in the description which follows, and in part, will be obvious from the description, or may be learned by practice of the invention. The objects, features and advantages of the invention may be realized and obtained by means of the instrumentalities and combination particularly pointed out in the appended claims.

DETAILED DESCRIPTION OF A PREFERRED INVENTION

The reference of the alloys follows the rules of The Aluminum Association. Unless indicated otherwise, the chemical compositions are given as percentages by weight based on the total weight of the material. The metallurgical tempers are defined in the European standard EN515. Unless indicated otherwise, static mechanical characteristics, including i.e. the ultimate tensile strength $R_m$, the tensile yield strength $R_{p0.2}$ and the elongation at fracture A, are determined by a tensile test according to the standard EN 10002-1 on proportional test pieces (which are characterised by an initial length between references $L_o=5.65\sqrt{S_o}$, where $S_o$, represents the area of the initial cross-section) sampled in the LT (long transverse) direction. The term "sheet" as used here includes all flat products such as sheet, shate, plate, thick plate and any rolled product.

The applicant surprisingly found that, it is highly advantageous to select a very narrow Al—Mg—Mn—Zn composition range which is clearly distinguished from that of a 5186 alloy. Particularly, it is advantageous to increase the magnesium content, to add a small amount of zinc, and to reduce the content of the minor addition elements, Fe, Si and Mn, while generally keeping them above a minimum level.

Indeed it is well-known to use magnesium to increase mechanical characteristics ($R_{0.2}$ and $R_m$) of certain aluminium alloy types. It has been observed that a magnesium content of preferably at least 4.85%, preferentially at least 4.90% and more preferentially at least 4.95% or even 5.00%, makes it possible to obtain a desired or some required levels of mechanical characteristics. However, at levels above about 5.35% magnesium, the corrosion resistance starts to deteriorate. This maximum value of about 5.30% is generally preferred.

The addition of zinc in sufficient quantity (preferably a minimum of 0.20%, preferentially at least 0.25%, and more preferentially at least 0.30%) proves to have a beneficial effect on the mechanical characteristics of sheets and on the yield strength at the welded seams. In addition, Zn also improves the corrosion resistance. Within the scope of the present invention, it is preferred to have a Zn content of 0.45% or less. A content between 0.25% and 0.40% is advantageous in many embodiments.

It was further observed that a minimal content of about 0.20% manganese should preferably be maintained in order to control the granular structure of the sheet, but Mn should preferably be less than or equal to about 0.50% and preferentially not greater than about 0.40% in order to prevent coarse intermetallic phase formation and to facilitate recrystallization in a final temper. A preferred range of Mn is from 0.25 to 0.35%. The presence of manganese in sufficient quantity also contributes to obtaining many desirable mechanical characteristics that are sought in many embodiments of the present invention.

In the 5xxx alloys, the presence of copper is known to degrade the general corrosion resistance. It has been found that it is preferable to maintain the copper content less than or equal to 0.25%. A Cu content preferably less than about 0.20%, less than 0.15% or even less than 0.10% is preferred in many embodiments.

Iron and silicon are usual inevitable impurities in aluminium alloys. Within the scope of the present invention, the iron content should preferably not exceed about 0.30% and the silicon content should preferably be about 0.20% or less. However, it has been surprisingly observed that the presence of a certain quantity of iron and silicon is beneficial in order to achieve some objects of the present invention. For example, an Si content of at least about 0.05% favours a finely recrystallised granular microstructure, and an Fe content of at least about 0.10% is preferred in order to achieve some desired physical characteristics.

A product according to the present invention may optionally contain a relatively small quantity of chromium, titanium and/or zirconium. The content of each of these elements individually should preferably not exceed about 0.15% and more preferentially, should not exceed about 0.10%, since an excessively high content of any of these elements could limit recrystallisation and lead to a decrease in the value of A.

Products according to the invention are advantageously produced by semi-continuous casting, followed by processing steps corresponding to the desired product shape. These steps include extrusion for extruded or drawn products (i.e. bars, tubes, profiles, wires), and rolling for rolled products (i.e. sheets, strips, plates). In the case of rolled products, the rolling ingots produced by semi-continuous casting are preferably hot rolled, and then optionally cold rolled if desired for any reason. The strips are advantageously planed and converted into sheets. In such a manufacturing method, it is often beneficial to adjust any one of (i) the hot rolling mill output temperature, (ii) the winding temperature, and/or (iii) the cold working rate. Each of these aspects may influence the mechanical characteristics of the product, and this should be adjusted carefully. A preferred final thickness is generally between 3 and 12 mm. In a preferred embodiment of the invention, a sheet is obtained directly at the final thickness by hot rolling. In this case, a hot rolling mill output temperature is advantageously selected between 260° C. and 330° C. and preferentially between 290° C. and 330° C. Below 260° C., the microstructure obtained may not be well-suited to the target application, and above 330° C., a coarsening of the grain which degrades the desired mechanical characteristics may be observed. This particular embodiment of the invention, i.e. the direct production of sheets at the final thickness by hot rolling, also facilitates the manufacture of very wide sheets, for example, sheets having a width of up to or even greater than 3000 mm, and preferentially greater than 3300 mm, and more preferentially greater than 3500 mm.

According to a preferred embodiment, a product according to the invention is characterised by an elongation at fracture A of at least about 24%, and preferentially of at least 27%. This characteristic facilitates the use of the product. For example, such elevation values provide rolled sheets with excellent bendability and formability.

In another preferred embodiment, three parameters $R_{p0.2(LT)}$, $R_{m(LT)}$ and $A_{(LT)}$ are optimized. The "LT" index indicates that these mechanical characteristics are measured on tensile test pieces sampled in the long transverse direction (perpendicular to the direction of rolling) of the sheets. By adjusting the chemical composition in the indicated zones in an appropriate manner as known in the art it is generally possible to obtain, a product with (i) a tensile yield strength $R_{p0.2(LT)}$ of at least about 145 MPa, preferentially at least about 150 MPa and more preferentially at least 170 MPa, (ii) an ultimate tensile strength $R_{m(LT)}$ of generally at least 290 MPa and preferentially at least 300 MPa, and (iii) an elongation at fracture $A_{(LT)}$ of generally least 24% and preferentially at least 27%.

For example, it is possible to choose advantageously a Mn content of from preferably 0.20–0.40, a Zn content of preferably>0.25 and preferentially>0.30, an Fe content of at least about 0.10%, Fe and a silicon content of preferably at least about 0.10%.

According to another preferred embodiment, it is desirable to optimise the $R_{m(LT)} \times A_{(LT)}$ product. By adjusting the chemical composition in the indicated ranges in an appropriate manner, it is generally possible to obtain an $R_{m(LT)} \times A_{(LT)}$ product, (wherein $R_{m(LT)}$ is expressed in MPa and $A_{(LT)}$ as a percentage, measured on test pieces sampled in the LT direction), that is preferably greater than about 8200, preferentially greater than 8500 and more preferentially greater than 9000. It is highly advantageously that these $R_{m(LT)} \times A_{(LT)}$ products are obtained, while at the same time retaining a sufficient level of $R_{p0.2(LT)}$. This product, particularly in sheet form, is particularly suitable for the manufacture of tankers, particularly for the road and rail transport of hazardous substances as well as other similar or related uses.

The products according to the present invention demonstrate a corrosion resistance at least as good as known comparable Al—Mg alloys, despite a notably higher magnesium content. This effect was completely unexpected because prior to this discovery, it would have been thought that increasing Mg levels would decrease corrosion resistance. Within the scope of the present invention, this corrosion resistance is preferentially characterised either, (i) by the loss of mass and by the maximum metal depth showing defects due to intergranular corrosion after an intergranular corrosion test, Official Journal of the European Communities, Nov. 19, 1984, No. L300-35 to 43, or (ii) by a stress corrosion test conducted according to the standard ASTM G 30, G39, G44 and G49. A stress corrosion test may be conducted advantageously with reference to the standard ASTM G 129, since good correlation between such standards and the standard ASTM G 129 are already established (see R. Dif et al., Proceedings of the 6$^{th}$ International Conference on Aluminium Alloys, 1998, Toyohashi, Japan, pp. 1615–1620, and R. Dif et al., Proceedings of the Eurocorr Conference 1997, Trondheim, Norway, pp. 259–264).

The intergranular corrosion test selected is considered to be representative of natural exposure in a marine atmosphere (R. Dif et al., Proceedings of the Eurocorr Conference, 1999, Aachen, Germany).

The corrosion behaviour is evaluated not only in the initial state but also after artificial aging treatments wherein the conditions may vary. A 7-day treatment at 100° C. has been conventionally used on 5xxx series alloys in order to reproduce natural aging at ambient temperature for around twenty years (E. H. Dix et al., Proceedings of the 4$^{th}$ annual Conference of NACE, San Francisco, USA, 1958).

In very particular cases of use, structures and materials of the present invention may be subjected to relatively high temperatures (i.e. above about 60° C.). Those skilled in the art know that under these conditions, some 5xxx series alloys may develop a susceptibility to corrosion after such exposure. In order to study this susceptibility to corrosion (so-called sensitisation phenomenon), it may be advisable to conduct heat treatments that are more extensive than the 7 days at 100° C. disclosed by Dix et. al,. supra. An "equivalent time concept" is generally used to limit the number and duration of the treatments to be conducted. More specifically, according to such an equivalent time concept, a treatment of duration $t_1$ is performed at a temperature $T_1$, and this will be equivalent to a treatment of duration $t_2$ performed at temperature $T_2$, given by the equation (R. Dif et al., Proceedings of the 6$^{th}$ International Conference on Aluminium Alloys, 1998, Toyohashi, Japan, pp. 1489–1494):

$$t_1 \cdot \exp\left(-\frac{Q}{R \cdot T_1}\right) = t_2 \cdot \exp\left(-\frac{Q}{R \cdot T_2}\right)$$

where the temperatures are expressed in Kelvin (K). Q represents the thermal activation energy of magnesium diffusion (in J/mol). R is the perfect gas constant.

The value of the ratio $$\frac{Q}{R}$$

from the literature is of the order of 10,000 K to 13,500 K.

In one embodiment of the present invention, the products according to the invention show an intergranular corrosion resistance in an intergranular test which is preferably characterised at least by a loss of mass of less than 20 mg/cm$^2$ after aging for 7 days at 100° C., and by a maximum etching depth of preferably less than 130 μm, and preferentially less than 70 μm.

Preferentially, said products also show, a loss of mass of less than about 50 mg/cm$^2$ and more preferentially less than 30 mg/cm$^2$, and a maximum etching depth of less than about 250 μm, and preferentially less than 100 μm after aging for 20 days at 100° C. Some of the most preferred products within the scope of the present invention preferably demonstrate, a loss of mass of preferably less than 95 mg/cm$^2$ and preferentially less than 80 mg/cm$^2$, and more preferentially less than 60 mg/cm$^2$, and a maximum etching depth of less than about 450 μm, and preferentially less than 400 μm after aging for 20 days at 120° C. It should be understood that this characteristic of increased corrosion resistance is added to at least one of the characteristics mentioned above, i.e. after aging for 20 days at 100° C. or 20 days at 120° C. Products of the present invention, typically have excellent mechanical characteristics (for example an $R_m \times A$ product of at least 8500 or 9000), and they are also particularly well-suited for use in manufacturing welded constructions, such as road or rail tankers, as explained in more detail below.

With respect to analyzing corrosion resistance under stress, in connection with the present invention, it is preferable in many instances to employ a slow strain rate testing method, as described for example in the standard ASTM G129. This test is more rapid and has proven to be more discriminating than conventional methods that involve the determination of the non-fracture threshold stress in a stress corrosion, provided that the experimental conditions are well-controlled.

Slow Strain Rate Testing

The principle of the slow strain rate test involves comparing the tensile properties in inert media (laboratory air) and in corrosive media. The decrease in the static mechanical properties in corrosive media corresponds to the susceptibility to stress corrosion. The most sensitive tensile test characteristics are (i) the elongation at fracture A and (ii) the maximum stress (contraction) $R_m$. It was observed that the elongation at fracture is a markedly more discriminating parameter than the maximum stress. It is highly desirable, therefore, to ensure that the decrease in the static mechanical characteristics indeed corresponds to stress corrosion, defined as the synergic and simultaneous action of mechanical stress and the environment. Therefore, tensile tests in an inert media (laboratory air), were also performed after preliminary pre-exposure of the test piece, without stress, in a corrosive medium, for the same time as the tensile test performed in the medium as previously described. It was determined that if the tensile characteristics obtained were not different from those obtained in inert media, the susceptibility to stress corrosion may then be defined using an "SC susceptibility" index defined as:

$$I = \frac{A\%_{inert\ medium} - A\%_{corrosive\ medium}}{A\%_{inert\ medium}} \times 100$$

Critical aspects of the slow strain rate test relate to several factors including the choice of the tensile test piece, the deformation rate and the corrosive solution. A test piece (sampled in the long transverse direction) having a scalloped shape with a radius of curvature of 100 mm, was used which made it possible to locate the deformation and render the test even more severe.

With respect to the stress rate, an excessively rapid rate did not allow the stress corrosion phenomena to develop, but an excessively slow rate masks the stress corrosion, and such as a deformation rate of $5\times10^{-5}$ $s^{-1}$ (corresponding to a transverse movement speed of $4.5\times10^{-2}$ mm/min) was used. This made it possible to maximise the effects of stress corrosion (see R. Dif et al., Proceedings of the $6^{th}$ International Conference on Aluminium Alloys, 1998, Toyohashi, Japan, pp. 1615–1620).

With respect to the corrosive environment to be used, the same type of problem is involved given that an excessively corrosive medium masks the stress corrosion, but an insufficiently severe environment does not make it possible to demonstrate corrosion phenomena. Thus, a 3% NaCl+0.3% $H_2O_2$ solution was used successfully within the scope of the present invention.

Products according to the invention may be used advantageously for any desired application and are particularly adapted for welded construction, for the construction of road or rail tankers or for the construction of industrial vehicles, and related and unrelated uses. They may also be used for the construction of motor car bodywork (panels), particularly as reinforcement parts. Products of the present invention possess good formability properties, including SPF properties.

Advantageously, products according to the present invention can be used to prepare rolled sheets in a low cold worked metallurgical temper, such as the O temper or H111 temper, preferably having a thickness between about 3 mm and about 12 mm, and preferentially between 4.5 mm and 10 mm. For the construction of road or rail tankers, the sheets are preferably characterised by an $R_{m(LT)}\times A_{(LT)}$ product greater than 8200, preferentially greater than 8500 and more preferentially greater than 9000, and should also possess good corrosion resistance according to the standards discussed herein and as known in the industry for such end uses. For example, the loss of mass in an intergranular resistance test is preferably less than about 30 mg/cm$^2$ after aging for 20 days at 100° C., and the SC slow strain rate testing index is preferably less than about 50% after aging for 20 days at 100° C.

Products according to the present invention may be welded using any desired welding methods that can be used for Al—Mg type alloys, such as MIG or TIG welding, friction welding, laser welding, electron beam welding, to name a few. More particularly, it was observed that MIG welding of products according to the present invention results in welded seams characterised by a fracture limit that is generally at least as high as fracture limits of known alloys such as 5186. These fracture limit tests for MIG welded products were performed in the long transverse direction on butt-welded sheets in H111 temper with a V-shaped chamfer by smooth stream semi-automatic MIG welding, with a 5183 alloy filler wire. The mechanical tests were performed on tensile test pieces sampled in the longitudinal direction (perpendicular to the weld seam) with a symmetrically flush seam and with a non-flush seam, or in the LT direction. On a test piece sampled in the longitudinal direction, a value of $R_m$ of at least 275 MPa is found, which underlines the material's excellent suitability for use in welded constructions.

The following examples illustrate different embodiments of the invention and demonstrate its advantages; they do not restrict this invention.

EXAMPLES

Example 1

Rolling ingots were produced from various alloys by means of semi-continuous casting. Their composition is given in table 1. The chemical analysis of the elements was performed by spark spectroscopy on a spectrometry slug obtained from liquid metal sampled in the casting channel.

The rolling ingots were heated and then hot rolled. For example, the ingot corresponding to example H1 was heated in three stages: 10 hours at 490° C., 10 hours at 510° C., 3 hrs 45 min at 490° C. and then hot rolled with an entry temperature of 490° C. and a winding temperature of 310° C. For the ingots corresponding to examples H2, I1, I2, I3 and I4, the heating was performed in two stages (21 hrs at 510° C.+2 hrs at 490° C.), the rolling entry temperatures were 477° C., 480° C., 479° C., 474° C. and 478° C., respectively, while the winding temperatures were 290° C., 300° C., 270° C., 310° C. and 300° C., respectively. After the winding, all the sheets were planed and cut.

TABLE 1

| Alloy | Mg | Zn | Mn | Si | Fe | Cu | Zr | Ti | Cr |
|---|---|---|---|---|---|---|---|---|---|
| A | 4.28 | 0.06 | 0.31 | 0.11 | 0.26 | 0.04 | <0.01 | 0.02 | 0.08 |
| B | 4.45 | 0.12 | 0.43 | 0.14 | 0.28 | 0.06 | <0.01 | 0.02 | 0.09 |
| C | 4.68 | 0.02 | 0.26 | 0.09 | 0.25 | 0.06 | <0.01 | 0.03 | 0.01 |
| D | 4.54 | 0.03 | 0.27 | 0.10 | 0.23 | 0.04 | <0.01 | 0.01 | 0.01 |
| F | 4.42 | 0.07 | 0.28 | 0.13 | 0.25 | 0.07 | <0.01 | 0.02 | 0.03 |
| E | 4.31 | 0.04 | 0.32 | 0.13 | 0.27 | 0.05 | <0.01 | 0.02 | 0.07 |
| G | 5.05 | 0.38 | 0.29 | 0.12 | 0.22 | <0.01 | <0.01 | 0.02 | 0.01 |
| H1, H2 | 5.19 | 0.38 | 0.31 | 0.08 | 0.15 | 0.01 | <0.01 | 0.02 | 0.01 |
| I1 to I4 | 5.30 | 0.26 | 0.33 | 0.10 | 0.16 | 0.05 | <0.02 | 0.02 | 0.02 |

Alloys A, B, C, D, E, and F are alloys according to the state of the art. Alloys G, H and I are alloys according to the invention.

The properties of the sheets produced from these alloys are given in Table 2. The sheets bear the same reference letter as the alloy wherein they were produced.

TABLE 2

Sheet properties

| Sheet | Temper | Thickness [mm] | $R_{m(LT)}$ [MPa] | $R_{p0.2(LT)}$ [MPa] | $A_{(LT)}$ [%] | $Rm_{(LT)} \times A_{(LT)}$ |
|---|---|---|---|---|---|---|
| A | H111 | 6.5 | 278 | 170 | 23 | 6394 |
| B | H111 | 5.1 | 300 | 177 | 23 | 6900 |
| C | O | 5.4 | 290 | 149 | 26.5 | 7685 |
| D | H111 | 6.2 | 274 | 138 | 28 | 7672 |
| E | O | 4.9 | 287 | 147 | 27 | 7749 |
| F | H111 | 5.3 | 294 | 170 | 23.5 | 6909 |
| G | H111 | 4.7 | 300 | 180 | 27.7 | 8310 |
| H1 | H111 | 5.0 | 308 | 154 | 28.5 | 8778 |
| H2 | H111 | 5.0 | 309 | 176 | 29 | 8961 |
| I1 | H111 | 6.1 | 301 | 148 | 28.1 | 8458 |
| I2 | H111 | 8.1 | 321 | 182 | 26.8 | 9602 |
| I3 | H111 | 6.1 | 300 | 149 | 29.6 | 8880 |
| I4 | H111 | 5.1 | 310 | 164 | 28.3 | 8773 |

Example 2

Two 5.0 mm thick sheets in H111 temper corresponding to example H1 were butt-welded in the long transverse direction with a V-shaped chamfer (45° angle) by smooth stream semi-automatic MIG welding. A 5183 alloy (Mg 4.81%, Mn 0.651%, Ti 0.120%, Si 0.035%, Fe 0.130%, Zn 0.001%, Cu 0.001%, Cr 0.075%) filler wire, 1.2 mm thick, supplied by Soudure Autogène Française was used.

The test piece was sampled in the longitudinal direction through the welded seam so that the seam was in the center. With the symmetrically flush seam, a value of $R_m$ of 285 MPa was found, along with a value of 311 MPa with a non-flush seam.

The same test was conducted on two sheets corresponding to the H2 sheet. With the symmetrically flush weld seam, a value of $R_m$ of 290 MPa was found. With a non-flush seam, a value of 318 MPa was found. As a comparison, 283 MPa is obtained with a flush seam on sheets of comparable thickness according to the prior art (see L. Cottignies et al., "AA 5186: a new aluminium alloy for welded constructions", Journal of Light Metal Welding and Construction, 1999).

The same test was conducted on two sheets corresponding to the sheets I2 and I4; for this test, the test pieces were sampled in the LT direction via the welded seam. The following results were found:

| Sheet | Direction of stress | Direction of weld | Flush seam or not | Rp0.2 [MPa] | Rm [MPa] | A [%] |
|---|---|---|---|---|---|---|
| I4 | LT | L | Flush | 153 | 291 | 13.0 |
| I2 | LT | L | Flush | 156 | 293 | 16.8 |
| I4 | LT | L | Non-flush | 155 | 312 | 18.4 |
| I2 | LT | L | Non-flush | 163 | 323 | 21.3 |

Example 3

On sheets produced as described in example 1, LDH (Limit Dome Height) tests were performed. The LDH is a peripheral blocked blank drawing test (R. Thompson, "The LDH test to evaluate sheet metal formability—Final report of the LDH committee of the North American Deep Drawing Research Group", SAE Conference, Detroit, 1993, SAE Paper No. 93-0815). The 490 mm×490 mm blank is subjected to equiaxed bi-expansion stress. The lubrication between the punch (diameter 250 mm) and the sheet is provided by a plastic film and grease. The LDH value is the displacement of the punch at fracture, i.e. the limit drawing depth.

A value of 101 mm is obtained for the H1 sheet, and a value of 94.1 mm for the H2 sheet. As a comparison, an LDH value of 94.3 mm had been obtained for an alloy of the prior art with a comparable thickness (see L. Cottignies et al., "AA 5186: a new aluminium alloy for welded constructions", Journal of Light Metal Welding and Construction, 1999).

Example 4

On a sheet of the prior art (5186) and the sheet corresponding to example H1, slow strain rate testing was conducted according to the method and with the parameters described here in under the heading "Slow Strain Rate Testing". The elongation values obtained for the two alloys and the different aging conditions are given below in table 3.

TABLE 3

Slow Strain Rate Testing Results

| Alloy | Aging | A % Air | A % NaCl + $H_2O_2$ | A % Pre-Exposure | 1% SC index |
|---|---|---|---|---|---|
| Prior art | None | 22.8 | 22.8 | Not tested | 0% |
| | 7 d 100° C. | 24.2 | 24.0 | Not tested | 1% |
| | 20 d 100° C. | 25.0 | 10.5 | 24.4 | 58% |
| | 20 d 120° C. | 24.6 | 5.4 | 24.4 | 78% |
| Invention (H1) | None | 28.9 | 29.8 | Not tested | 0% |
| | 7 d 100° C. | 30.4 | 30.5 | Not tested | 0% |
| | 20 d 100° C. | 30.7 | 21.3 | 30.8 | 31% |
| | 20 d 120° C. | 30.3 | 7.7 | 30.6 | 75% |

It was observed that the alloy according to the present invention showed improved stress corrosion resistance after aging as compared to 5186, particularly for intermediate ageing levels, despite a higher magnesium content.

Intergranular corrosion tests were conducted on the H1, H2, I2 and I4 sheets, corresponding to the invention, and on a 5186 alloy sheet according to the state of the art, according to the recommendations of the Official Journal of the European Communities, Nov. 19, 1984, No. L300, 35 to 43, incorporated herein by reference, using solution B (30 g/l NaCL+5 g/l HCl), on 30 mm*30 mm*5 mm samples. The results obtained in these tests are given in Table 4, with reference to the results of the prior art.

TABLE 4

| | Loss of mass [mg/cm$^2$] | | | | | Maximum pit depth [μm] | | | | |
|---|---|---|---|---|---|---|---|---|---|---|
| Sheet | Not aged | 7 d at 100° C. | 20 d at 100° C. | 20 d at 120° C. | 40 d at 120° C. | Not aged | 7 d at 100° C. | 20 d at 120° C. | 20 d at 120° C. | 40 d at 120° C. |
| 5186 | 20 | 47 | 77 | 101.5 | 122.5 | 100 | 220 | 400 | 550 | 650 |
| H1 | 3.5 | 19 | 17.5 | 66 | 94 | 40 | 50 | 90 | 280 | 420 |
| H2 | 3.5 | 6 | 12 | 54 | 75.5 | 30 | 130 | 110 | 350 | 450 |
| 14 | 9.5 | 18.5 | 35.5 | 93.5 | | 60 | 120 | 250 | 450 | |
| 12 | 7.5 | 9.5 | 11 | 31 | | 50 | 50 | 50 | 150 | |

The alloy according to the invention showed at least a comparable level of intergranular corrosion resistance, and in some instances was even unexpectedly improved with respect to that of the prior art.

Example 5

A rolling ingot of the following composition was produced by semi-continuous casting:

Mg 5.0%, Zn 0.30%, Mn 0.35%, Si 0.01%, Fe 0.15%, Cu 0.03%, Zr 0.02%, Cr 0.03%, Ni<0.01%, Ti 0.02%. After homogenisation for 19 hours at 505° C., the ingot was hot rolled to a thickness of 7 mm. After light planing, the sheets were annealed with a temperature rise to 378° C. for 8 hours, followed by maintenance for 30 minutes at a temperature between 378° C. and 390° C.

The sheets obtained in this way have the following mean mechanical characteristics (LT direction):

$R_m$=297 MPa, $R_{p0.2}$=139 MPa, A=28.9%.

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

The priority document, French Patent Application No. 02-03593, filed Mar. 22, 2002 is incorporated herein by reference in its entirety.

As used herein and in the following claims, articles such as "the", "a" and "an" can connote the singular or plural.

All documents referred to herein are specifically incorporated herein by reference in their entireties.

We claim:

1. An Al—Mg alloy wrought recrystallized product, comprising: (percentage by weight)

| | | |
|---|---|---|
| Mg 4.85–5.35 | Mn 0.20–0.50 | Zn 0.20–0.45 |
| Si < 0.20 | Fe < 0.30 | Cu < 0.25 |
| Cr < 0.15 | Ti < 0.15 | Zr < 0.15 |

the remainder being aluminium with its inevitable impurities, wherein a $R_{m(LT)} \times A_{(LT)}$ product, $R_{m(LT)}$ being expressed in MPa and $A_{(LT)}$ as a percentage, is greater than 8200.

2. A product according to claim 1, wherein Mg 4.90–5.30%.

3. A product according to claim 1, wherein Mn 0.20–0.40%.

4. A product according to claim 1, wherein Mn 0.25–0.35%.

5. A product according to claim 1, wherein Zn 0.25–0.40%.

6. A product according to claim 1, wherein Cu<0.20.

7. A product according to claim 1, wherein said product comprises at least 0.10% iron.

8. A product according to claim 1, wherein said product comprises at least 0.05% silicon.

9. A product according to claim 1, wherein said product comprises at least 4.95% magnesium.

10. A product according to claim 1, wherein said product comprises at least 5.0% magnesium.

11. A product according to claim 1, wherein said product has an elongation at fracture A of ax least 24%.

12. A product according to claim 1, wherein said product has a tensile yield strength $R_{p0.2(LT)}$ of at least 145 MPa, an ultimate tensile strength $R_{m(LT)}$ of at least 290 MPa, and an elongation at fracture $A_{(LT)}$ of at least 24%.

13. A product according to claim 12, wherein said tensile yield strength $R_{p0.2(LT)}$ is at least 150 MPa.

14. A product according to claim 12, wherein said elongation at fracture $A_{(LT)}$ is at least 27%.

15. A product according to claim 13, wherein said ultimate tensile strength $R_{m(LT)}$ is at least 300 MPa.

16. A product according to claim 1, wherein a loss of mass after an intergranular corrosion test after aging for 7 days at 100° C. is less than 20 mg/cm$^2$.

17. A product according to claim 1, wherein a loss of mass after an intergranular corrosion test after aging for 20 days at 100° C. is less than 50 mg/cm$^2$.

18. A product according to claim 1, wherein a loss of mass after an intergranular corrosion test after aging for 20 days at 120° C. is less than 95 mg/cm$^2$.

19. A rolled sheet comprising a product of claim 1.

20. A sheet according to claim 19, wherein said sheet has a thickness between 3 mm and 12 mm.

21. A sheet according to claim 20, wherein said thickness is between 4.5 mm and 10 mm.

22. A sheet according to claim 19, wherein said sheet has been produced by hot rolling from an ingot obtained by semi-continuous casting.

23. A sheet according to claim 22, wherein the hot rolling is conducted via a mill having an output temperature between 260° C. and 330° C.

24. A welded construction comprising a sheet of claim 19.

25. A tanker comprising a sheet of claim 19.

26. An industrial vehicle construction comprising a sheet of claim 19.

27. A car body sheet comprising a sheet of claim 19.

28. A tanker produced at least partially with a sheet of a recrystallized alloy comprising (percentage by weight):

| | | |
|---|---|---|
| Mg 4.95–5.35 | Mn 0.20–0.50 | Zn 0.25–0.45 |
| Si 0.05–0.20 | Fe 0.10–0.30 | Cu < 0.25 |
| Ti < 0.15 | Zr < 0.10 | Cr < 0.15 |

the remainder being aluminium with its inevitable impurities, said sheets having an $R_{m(LT)} \times A_{(LT)}$ product of at least 8500.

29. A tanker according to claim 28, wherein said sheet has a corrosion resistance as measured by a loss of mass during an intergranular corrosion test of less than 50 mg/cm$^2$ after aging for 20 days at 100° C.

30. A tanker according to claim 28, wherein said sheet has a stress corrosion resistance as measured by en SC index of less than 50% after aging for 20 days at 100° C.

31. A welded construction according to claim 24, comprising a welded seam, obtained by butt-welding in a long transverse direction with a V-shaped chamfer (450° angle) by MIG welding with a 5183 alloy filler wire, said welded seam having a value of $R_m$ of at least 275 MPa, measured on a test piece sampled in a longitudinal direction through said welded seam and arranged such that said welded seam is located at a center point located along a length of said test piece, after symmetric levelling of the welded seam.

32. A recrystallized sheet of the following composition (percentage by weight):

| | | |
|---|---|---|
| Mg 4.95–5.35 | Mn 0.20–0.50 | Zn 0.25–0.45 |
| Si 0.05–0.20 | Fe 0.10–0.30 | Cu < 0.25 |
| Ti < 0.15 | Zr < 0.10 | Cr < 0.15 |

the remainder being alumiuium with its inevitable impurities, said sheet having an $R_{m(LT)} \times A_{(LT)}$ product of at least 9000.

33. A rail or tanker truck having been produced by at least one sheet according to claim 32.

* * * * *